United States Patent [19]

Sakoda

[11] Patent Number: 4,542,269

[45] Date of Patent: Sep. 17, 1985

[54] COOKING APPLIANCE WITH SWITCHING ASSEMBLY

[75] Inventor: Yasuhiro Sakoda, Wakayama, Japan

[73] Assignee: Sharp Kabushiki Kaisha, Osaka, Japan

[21] Appl. No.: 602,166

[22] Filed: Apr. 19, 1984

[30] Foreign Application Priority Data

Apr. 26, 1983 [JP] Japan ..... 58-75926

[51] Int. Cl.[4] ..... H05B 6/68

[52] U.S. Cl. ..... 219/10.55 C; 219/10.55 B; 200/50 C; 126/197

[58] Field of Search ..... 219/10.55 C, 10.55 D, 219/10.55 B; 200/50 A, 50 C, 61.62, 61.8, 61.81, 61.83; 126/197; 292/254, DIG. 65

[56] References Cited

U.S. PATENT DOCUMENTS

| | | | |
|---|---|---|---|
| 4,006,121 | 2/1977 | Isono | 219/10.55 C X |
| 4,321,445 | 3/1982 | Kristof et al. | 219/10.55 C |
| 4,341,409 | 7/1982 | Sakoda | 292/254 |
| 4,450,335 | 5/1984 | Shimizu et al. | 219/10.55 C |
| 4,461,940 | 7/1984 | Ishimura | 219/10.55 C |

FOREIGN PATENT DOCUMENTS

| | | | |
|---|---|---|---|
| 52-14947 | 2/1977 | Japan | 219/10.55 C |
| 55-23801 | 2/1980 | Japan | 219/10.55 C |

*Primary Examiner*—Philip H. Leung

*Attorney, Agent, or Firm*—Birch, Stewart, Kolasch & Birch

[57] ABSTRACT

A switching assembly of a heating appliance, for example, a microwave oven, wherein when the heating button is operated (depressed) with the door securely closed, the heating lever causes a projection to be engaged with a hook in the tip of the latch head and simultaneously causes the actuation of the heating switch. Thus the heating switch commonly functions as a heating switch and as a safety switch. By using such a mechanism, the heating switch which activates the heating operation commonly functions as a safety switch that activates itself when the door is securely closed. When the heating button is operated, a rotatable heating lever activates the heating switch, and simultaneously securely engages the latch heads with the front panel of the microwave oven. As a result, a switching assembly incorporating a highly reliable safety switch which can be securely locked by a simple mechanism is provided for a heating appliance.

4 Claims, 6 Drawing Figures

COOKING APPLIANCE WITH SWITCHING ASSEMBLY

BACKGROUND OF THE INVENTION

The present invention relates to a switching assembly that operates in conjunction with the door opening and closing operations of a microwave oven.

Conventionally, a switching assembly that operates in conjunction with the door opening and closing operations of a microwave oven independently contains a pair of safety switches that activate themselves when the door is fully closed before a cooking operation is activated by operating the heating switch. Such a complex mechanism unavoidably uses a large number of parts, thus resulting in increased cost.

OBJECT AND SUMMARY OF THE INVENTION

In the light of such an existing disadvantage, the present invention is primarily directed to providing a microwave oven with a new switching assembly comprising a simplified mechanism.

Another object of the present invention is to provide a new mechanism comprising means for operating a lever in response to the activating of the heating operation after closing the door of a microwave oven, so that the activated force can be sent to the latch head and the heating switch can thus be caused to concurrently function also as a safety switch.

To achieve these objects, a preferred embodiment of the present invention provides a microwave oven with a switch that functions commonly as a heatintg and safety switch and also with an operating element that operates in conjunction with the heating button to be pressed and the door opening and closing operations, thus achieving a simplified switching assembly. Typically, a preferred embodiment of the present invention provides a tip part of the latch head which is supported by a rotary unit of the switching assembly base plate set to the microwave oven, whereby one end of said tip part comes into contact with the heating button when it is depressed and the other end is set to the door when the door is closed. The preferred embodiment of the present invention also provides a heating lever adjacent to the heating switch that contains a switch actuator in the lower part of the latch head tip. When the heating button is depressed, a projection engages with a hook in the tip of said latch head and a depressor depresses the activator of the heating switch said elements being positioned in the other end of said heating lever. Such a configuration allows the switching assembly to not only commonly function as the heating switch for activating a heating operation and as a safety switch that activates itself when the door is closed, but it also causes the depressed heating button to transfer the position of the heating lever to activate the heating switch so that the door latch head can be simultaneously engaged with the microwave oven.

As a result, the preferred embodiment of the present invention provides a microwave oven with a valuable switching assembly comprising a highly reliable safety switch that can be securely locked by a simple configuration thus described, resulting in a highly advantageous result.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

With reference to the attached drawings, a preferred embodiment of the present invention is described below.

Figure 1:
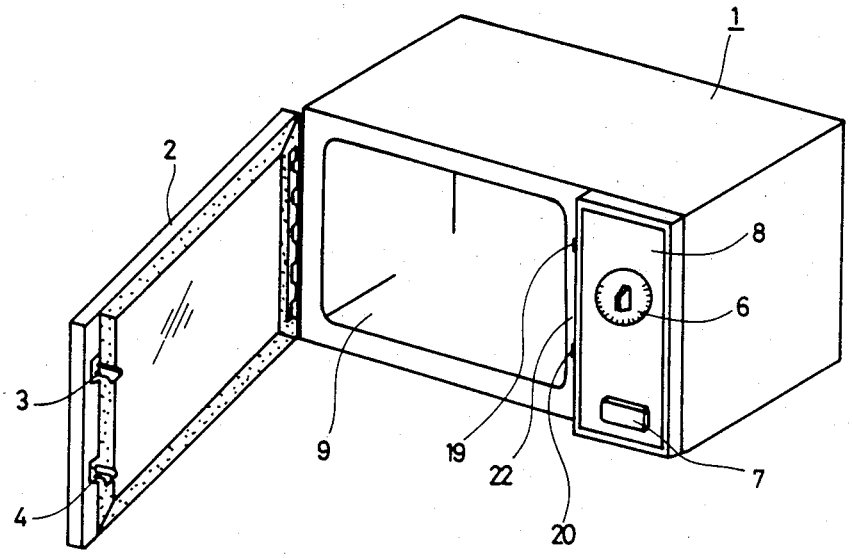
FIG. 1 is an external perspective view of a microwave oven containing the preferred embodiment of the present invention.

FIG. 1 is an external perspective view of a microwave oven containing a preferred embodiment of the present invention. Door 2 is secured to a microwave oven 1 via a pivot. Freely movable latch heads 3 and 4 are provided at the right edge of the inner door periphery, each protruding from the inner door edge surface and having a hook in the tip portion thereof. Control panel 8 that accommodates timer 6 and heating button 7 is installed at the right front panel of the microwave oven 1. With food (not shown) being placed in the oven 9, after closing the door 2 of the microwave oven 1 and then manually pressing the heating button 7, cooking is performed for a specific pre-determined period by timer 6.

Figure 2:
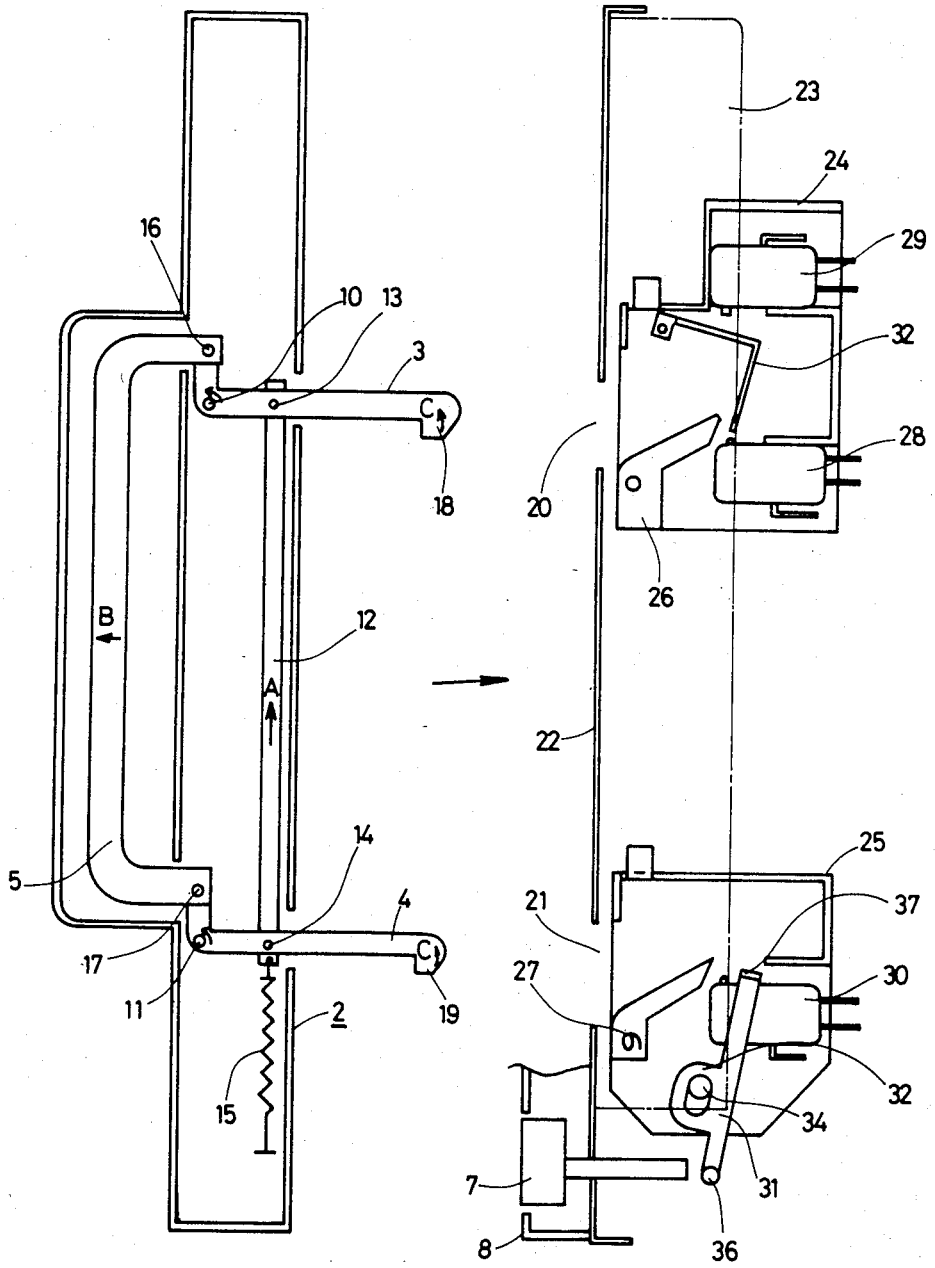
FIG. 2 is a sectional view of a switching assembly as the preferred embodiment of the present invention.

FIG. 2 is a sectional view of a switching assembly provide for the microwave oven 1 of FIG. 1 as a preferred embodiment of the present invention. Freely movable latch heads 3 and 4 are respectively held by pins 10 and 11 to allow their free movement. The latch heads 3 and 4 are connected to the connector lever 12. Pins 13 and 14 respectively cause the connector lever 12 to be engaged with said latch heads 3 and 4. Connector lever 12 is constantly energized by spring 15 in the direction of the arrow A, and yet, it freely moves in the vertical direction. Pins 16 and 17 secure the door handle 5 to the latch heads 3 and 4. When the door handle 5 is pulled in the direction of the arrow B, the latch heads 3 and 4, respectively, turn counterclockwise by pivoting pins 10 and 11. As a result, hooks 18 and 19 at the tips of said latch heads 3 and 4 respectively move in the direction of the arrow C. Space 20 and 21 respectively allow the latch heads 3 and 4 to freely enter into or be removed from the front panel 22 of the oven 9. Base plates 24 and 25 of switches 28 and 30 are respectively secured to the upper and lower portions of the bent side wall 23 of the front panel 22. Latch hooks 26 and 27, adapted to be engaged with latch heads 3 and 4 are integrally secured to said base plates 24 and 25 of switches 28 and 30. When the door is closed, the latch hooks 26 and 27 are engaged with the latch heads 3 and 4, thus securely locking the door 2 to the microwave oven 1. The first switch base plate 24 is provided with a first safety switch 28 which has first and second contacts and a monitor switch 29 which is constantly open. The second switch base plate 25 is provided with a constantly open second safety switch 30 that functions commonly as a heating switch and also with a heating lever 31. These switches 28, 29, and 30 are built in the door locking mechanism so that they can be activated in conjunction with the latch heads 3 and 4, respectively. Of these switches, both the opening and closing operations of the monitor switch 29 are controlled by the L-shaped switch lever 32 which is operated by being pressed by the tip of said latch head 3, whereas the second safety switch 30 is controlled by the opening and closing operations of the door 2 and also by the operation of the heating button to be described later on. A conventional door mechanism in which a latch switch is activated when the door is closed has already been disclosed by the preceding invention titled "DOOR LATCHING ASSEMBLY", U.S. Pat. No. 4,341,409, to Y. Sakoda.

With reference to the enlarged sectional views shown in FIGS. 3 and 4, a preferred embodiment of the present invention, particularly with respect to the configurations of the second safety switch and said heating lever 31 comprising the main part of the present invention will be described below.

Figure 3:
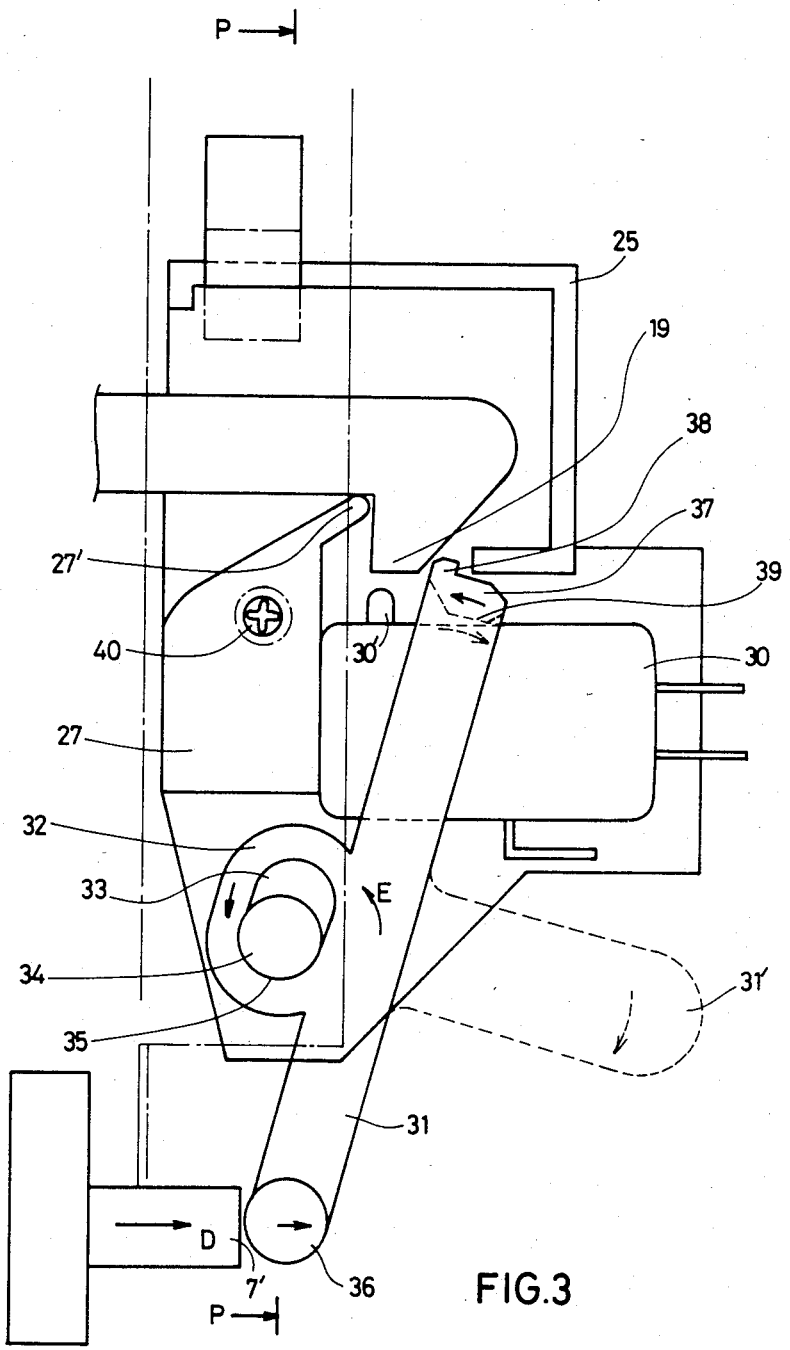
FIG. 3 is a sectional view of the main part of the switching assembly when the door is closed.

First, FIG. 3 shows a state in which the door 2 is closed. Hook 19 of the second latch head 4 is engaged with the tip 27' of the latch head 27. Reference 32 denotes a supporter for the pivoting heating lever 31, which is part of said heating lever 31 and contains an oval hole 33. The freely rotating supporter 32 is connected to pivot 34 that projects from the latch hook 27 which is integrally shaped together with said switch base plate 25. The pivot 34, when engaged with the heating lever 31, is constantly held in contact with the lower periphery 35 of said oval hole 33, surrounded by said supporter 32, when the door 2 is either in an opened or closed position, as shown in FIG. 3. One end 36 of the heating lever 31 is in such a position as to permit its contact with the heating button 7 when the button is depressed. The other end 37 has a projection 38 for engagement with hook 19 provided in the tip portion of the second latch head 4 when the door 2 is closed, and a depressive part 39 formed by depressing the actuator 30' of said heating switch 30. The other end 37 is constantly held in such a position allowing its access to the tip portion of the latch head 4 and the heating switch 30 that contains the actuator 30' in the lower part of the tip portion. Reference 40 denotes a screw securing hook 27 that is integrally formed together with the switch base plate 25 and side wall 23 that is formed by bending the front panel 22 of the oven 9.

When the heating button 7 is depressed in the arrowed direction D before starting the cooking operation, tip portion 7' of said heating button 7 comes into contact with one end 36 of the heating lever 31, and then said heating lever 31 starts to rotate counterclockwise as shown by arrow E, thus causing a projection 38 on the other end of the heating lever 31 to engage with hook 19 of the second latch head 4, and simultaneously, the depressive part 39 depresses the actuator 30' of the heating switch 30, thereby activating the heating switch 30. Since the heating switch 30 commonly functions as the second safety switch, such an operation of the heating button 7 provides the same results as the simultaneous operation performed by both the second safety switch and the heating switch.

As described above, the projection 38 at the other end 37 of the heating lever 31 engages hook 19 of the second latch head 4 to cause the actuator 30' to remain depressed by the weight of said latch head 4 itself. As a result, the pivot 34 comes into contact with the upper periphery 35' of the oval hole 33 of the heat lever supporter 32, and so the heating operation can be performed by securely holding the heating lever 31 in position even after releasing the depressed heating button 7, as shown in FIG. 4.

In a preferred embodiment of the present invention, a weight 31' is provided as part of the heating lever 31 to allow the lever to move in the direction of the arrow shown by dash line. Since the heating will be activated as soon as the door 2 is closed, if the heating lever remains engaged with the switch actuator, by releasing the lever, such an unwanted heating can be effectively prevented.

Figure 4:
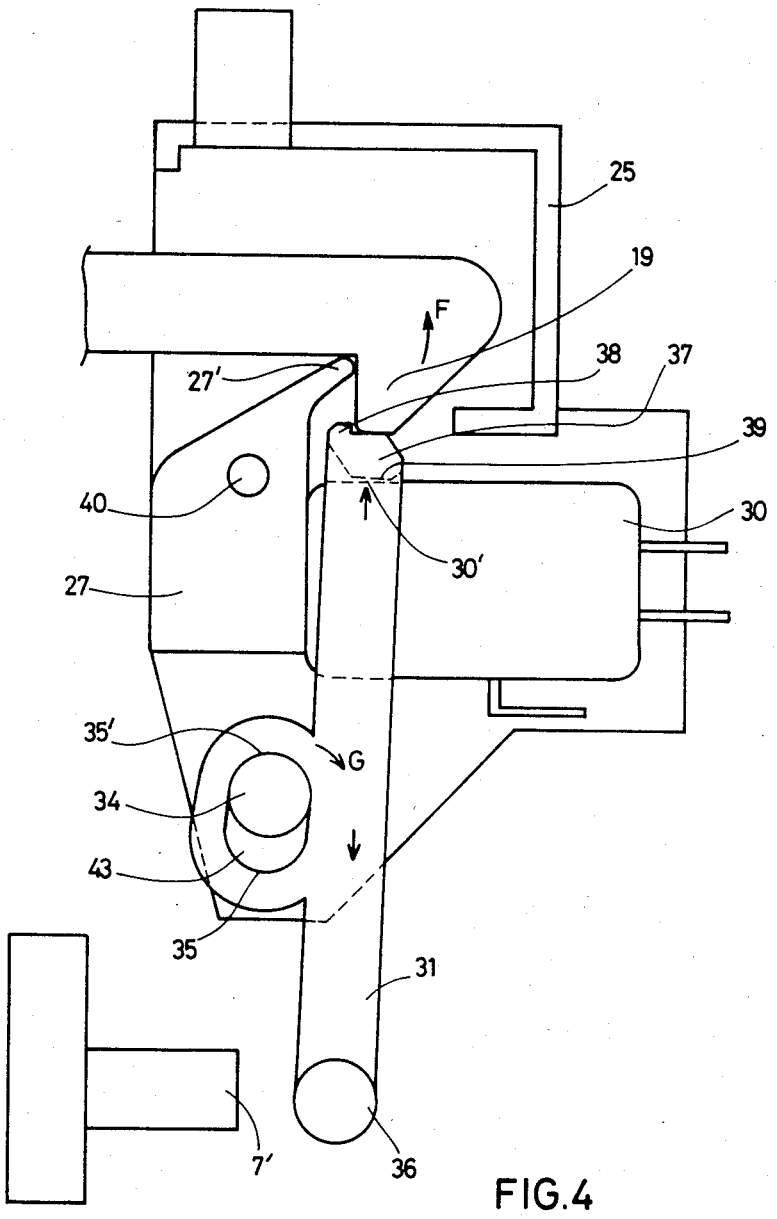
FIG. 4 is a sectional view of the main part of the switching assembly when the heating button is depressed and the door remains closed.

With reference to FIG. 4, as soon as the door 2 opens, latch head 4 moves in the direction of arrow F to disengage the projection 38 of the heating lever 31 from hook 19. This causes the heating lever 31 to turn clockwise as shown by arrow G until it returns to its original position as shown in FIG. 3. This also causes the actuator 30' of the heating switch 30 to be disengaged and released from the depressive part 39. As a result, switch 30 turns OFF itself to stop the heating operation.

Figure 5:
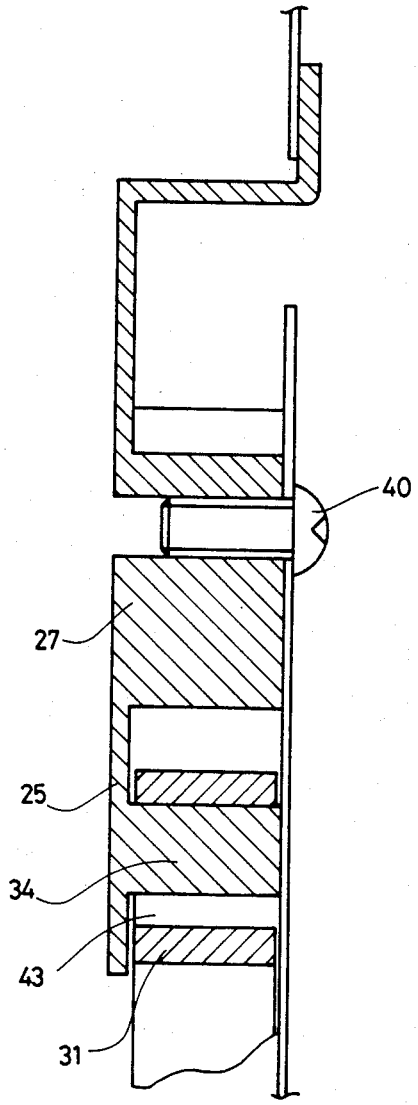
FIG. 5 is a sectional view of the main part P—P position shown in FIG. 3.

FIG. 5 shows a sectional view of the switching assembly in the P—P line shown in FIG. 3. The second switch base plate 25 is integrally formed together with hook 27, being secured to the side wall 23 of the front panel 22 of the oven 9 via screw 40. The heating lever 31 is sandwiched by said side wall 23 and second switch base plate 25 in such a state so that it can freely rotate.

Figure 6:
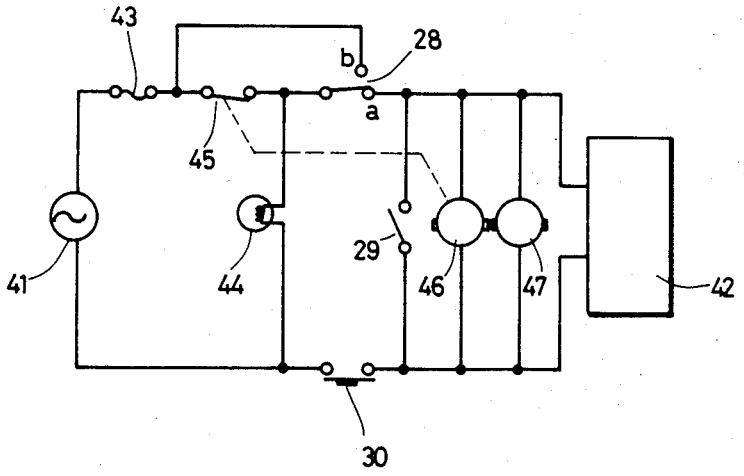
FIG. 6 is the main circuit diagram of a microwave oven incorporating a preferred embodiment of the present invention.

FIG. 6 is a simplified diagram showing the main electrical circuits of a microwave oven 1 incorporating the preferred embodiment of the present invention. The first and second safety switches 28 and 30 are respectively connected between the commercial AC power source 41 and the microwave oscillation circuit 42, whereas the monitor switch 29 is connected in parallel to the microwave oscillation circuit 42, which is also connected in series to fuse 43 and the first and second safety switches 28 and 30. When the door 2 is closed, the first safety switch 28 remains in contact with the contact point "a", which then comes into contact with the contact point "b" when the door 2 opens. When the door 2 is open, the oven lamp 44 lights up to illuminate the interior of the oven 9. Timer 6 provided in the operation panel 8 comprises the timer switch 45 and timer motor 46, which starts counting as soon as the heating button 7 is pressed ON and the second safety switch 30 which commonly functions as the heating switch turns OFF. Synchronous with these operations, the commercial AC power source 41 is connected to both the microwave oscillation circuit 42 and blower motor 47, thus activating the heating operation in the oven 9.

For any reason, if the door 2 has to be opened while still performing the cooking operation, since both the first and second safety switches 28 and 30 and the monitor switch 29 are respectively connected to the door locking mechanism, even if the timer switch remains OFF, current is securely shut off from flowing through the microwave oscillation circuit 42.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A heating apparatus comprising an oven housing and a door for opening and closing said oven housing, said door being provided with a latch mechanism for securing the door to said oven housing, means for heating an object in said oven housing a heating button provided on said oven housing for activating said heating means, a common switch disposed in said oven housing which functions as a safety switch for insuring the secure closing of the oven door, and as a heating switch for activating said heating means in response to the operation of the heating button, and an operating element in operable communication with both the heating button and the common switch whereby when the door is closed in the housing and the heating button is activated, the operating element lockingly engages the latch mechanism and activates said heating means.

2. The apparatus of claim 1 wherein the oven housing is provided with latch hooks so that when the door is closed the latch mechanism engages the latch hooks.

3. The apparatus of claim 1 wherein the operating element is a pivoting heating lever which is pivotally attached to the housing, one end of said heating lever provided with both a projecting means for engagement with the latch mechanism and a depressing means for simultaneously activating the heating switch and the other end thereof being in operative engagement with the heating button.

4. The apparatus of claim 3 wherein the pivoting heating lever is provided with a means for biasing said lever toward the heating button.

* * * * *